US006449779B1

(12) United States Patent
Nguyen

(10) Patent No.: US 6,449,779 B1
(45) Date of Patent: Sep. 17, 2002

(54) AUTOMATIC TOILET CLEANING DISPENSER ASSEMBLY

(75) Inventor: Jack Nguyen, Mission Viejo, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 0 days.

(21) Appl. No.: 09/795,992

(22) Filed: Feb. 28, 2001

(51) Int. Cl.[7] ..... E03D 9/00
(52) U.S. Cl. ..... 4/225.1; 4/222
(58) Field of Search ..... 4/225.1, 222, 223, 4/224, 226.1, 227.1, 309

(56) References Cited

U.S. PATENT DOCUMENTS

| | | | | | |
|---|---|---|---|---|---|
| 1,170,387 | A | * | 2/1916 | Andrews | 4/225.1 |
| 2,045,473 | A | | 6/1936 | Keillor | 4/227 |
| 2,708,754 | A | | 5/1955 | Hudgins | 4/225 |
| 2,993,214 | A | | 7/1961 | Franco | 4/228 |
| 3,061,842 | A | | 11/1962 | Woodruff | 4/225 |
| 3,105,245 | A | | 10/1963 | Finkbiner | 4/228 |
| 3,290,698 | A | | 12/1966 | Joyner et al. | 4/228 |
| 3,407,412 | A | | 10/1968 | Spear | 4/228 |
| 3,444,566 | A | | 5/1969 | Spear | 4/228 |
| 4,064,572 | A | | 12/1977 | Wicks, III et al. | 4/227 |
| 4,507,811 | A | | 4/1985 | Buelow et al. | 4/225 |
| 4,656,676 | A | | 4/1987 | Dufau et al. | 4/228 |
| 4,993,084 | A | * | 2/1991 | McCauley et al. | 4/224 |
| 5,042,095 | A | | 8/1991 | Schoepe et al. | 4/225 |
| 5,152,015 | A | | 10/1992 | Fourman | 4/225.1 |
| 5,745,928 | A | | 5/1998 | Armanno, Sr. | 4/225.1 |
| 5,881,396 | A | * | 3/1999 | Rivera | 4/225.1 |
| 6,151,722 | A | * | 11/2000 | Lubrano | 4/225.1 |
| 6,321,392 | B1 | * | 1/2001 | Sim | 4/225.1 |
| 6,240,572 | B1 | * | 6/2001 | Van Der Gaag et al. | 4/225.1 |

* cited by examiner

*Primary Examiner*—Gregory Huson
*Assistant Examiner*—Huyen Le
(74) *Attorney, Agent, or Firm*—Richard L. Myers; Myers, Dawes & Andras LLP

(57) ABSTRACT

A cleaning dispenser assembly to be used in connection with a toilet tank is coupled to a fill valve and an overflow tube of the tank. The dispenser assembly includes a container with a removable lid. A refill tube is coupled to a fill valve of the tank and the container. Tall and short discharge tubes are coupled to the container at different heights to facilitate the withdrawal of fluid from the container while preventing a vacuum from developing within the closed container. U-traps are formed in the refill tube and the discharge tubes to retain a portion of liquid in a steady state so as to seal the passageways in order to prevent gases from escaping into the tank.

21 Claims, 12 Drawing Sheets

AUTOMATIC TOILET CLEANING DISPENSER ASSEMBLY

BACKGROUND OF THE INVENTION

1. Field of the Invention

The invention relates generally to cleaning dispensers for toilet tanks.

2. Description of Prior Art and Related Information

Cleaning agents for toilets typically consist of water soluble material formed into a tablet. One area in which a cleaning agent is commonly disposed is in the toilet bowl. The cleaning agent is coupled to an interior of the bowl by supporting means, such as wires. Such a cleaning agent must be capable of dissolving quickly due to the short duration in which passing water makes contact with the agent. As a result, such cleaning agents get used quickly. The supporting means, therefore, must be manually replaced frequently.

Another area in which the tablet may be located is in the toilet tank. Since the material of the tablet is typically designed to dissolve quickly, such materials often release fumes and various other gases as a result of their dissolution into the water. The release of such fumes causes damage to the plumbing of toilet tank. Furthermore, cleaning agents which are simply placed inside the tank get dissolved by a large volume of water, which volume passes through with each flush. Not only is much of the cleaning agent wasted, the agent also gets used quickly, thus requiring frequent replenishment.

SUMMARY OF THE INVENTION

In accordance with the present invention, a structure and associated method are disclosed which overcome these deficiencies.

In one aspect, a cleaner dispenser apparatus is provided and adapted for use with a toilet tank having a refill valve and an overflow tube. The apparatus comprises a closed container for holding a cleaning agent. The container is adapted for disposition in the toilet tank in fluid communication with the refill valve. The apparatus further comprises a first conduit and a second conduit. The first conduit is adapted to couple the closed container to the overflow tube. The first conduit defines a first passageway in which liquid is disposed when the toilet is in a steady state subsequent to flushing. The second conduit is adapted to couple the closed container to the overflow tube. The second conduit defines a second passageway in which liquid is disposed when the toilet is in a steady state subsequent to flushing.

The closed container comprises a receptacle, a removable lid and a bottom wall. The first conduit has a first inlet and a first outlet. The second conduit has a second inlet and a second outlet. The first inlet is disposed further from the bottom wall of the closed container than the second inlet. The first outlet is disposed above the second outlet. The first conduit has an inner diameter sufficiently small to cause droplets of liquid disposed on an inner surface of the first conduit by way of surface tension to collect so as to block the first passageway. Each of the first passageway and the second passageway is bent back on itself to form a substantially U-shaped configuration.

In another aspect, a toilet is provided. The toilet comprises a water tank, a fill valve disposed in the water tank, a closed container adapted for holding a cleaning agent, a refill tube coupled to the fill valve and the closed container, an overflow tube, a first discharge tube coupled to the closed container and the overflow tube, and a second discharge tube coupled to the closed container and the overflow tube. The first discharge tube defines a first passageway. The second discharge tube defines a second passageway. The first discharge tube and the second discharge tube are configured to retain sufficient liquid to block the first passageway and the second passageway, respectively, at a steady state subsequent to flushing.

The first discharge tube comprises a first inlet and a first outlet. The second discharge tube comprises a second inlet and a second outlet. The first inlet is disposed above the second inlet. The second outlet disposed beneath the first outlet. In a preferred embodiment, the first discharge tube and the second discharge tube are U-shaped.

In a further aspect, a toilet cleaning apparatus is provided for use with a toilet tank having a refill valve and an overflow tube. The apparatus comprises means for holding a cleaning agent, means for directing liquid from the refill valve to the holding means, means for directing liquid from the holding means to the overflow tube, and means for preventing gas from escaping the holding means into the toilet tank when the toilet tank is in a steady state. The means for directing liquid from the holding means to the overflow tube further comprises means for simultaneously directing air into the holding means. The means for preventing gas from comprises means for trapping liquid.

A method for automatically cleaning a toilet having a tank is also provided. The method comprises channeling liquid from a fill valve to a closed container holding a cleaning agent upon flushing, directing the liquid in the closed container to an overflow tube via first and second discharge lines, directing air into the closed container via the first discharge line while siphoning fluid out of the closed container via the second discharge line, and preventing gas from escaping the closed container into the tank. Preventing gas from escaping the closed container into the tank comprises blocking the refill line, the first discharge line, and the second discharge line with the liquid.

In summary, a cleaning dispenser assembly to be used in connection with a toilet tank is coupled to a fill valve and an overflow tube of the tank. The dispenser assembly includes a container with a removable lid. A refill tube is coupled to a fill valve of the tank and the container. Tall and short discharge ports are coupled to the container at different heights to facilitate the withdrawal of fluid from the container while preventing a vacuum from developing within the closed container. U-traps are formed in the refill tube and the discharge tubes to retain a portion of liquid in a steady state so as to seal the passageways in order to prevent gases from escaping into the tank.

The invention, now having been briefly summarized, may be better visualized by turning to the following drawings wherein like elements are referenced by like numerals.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Figure 1:
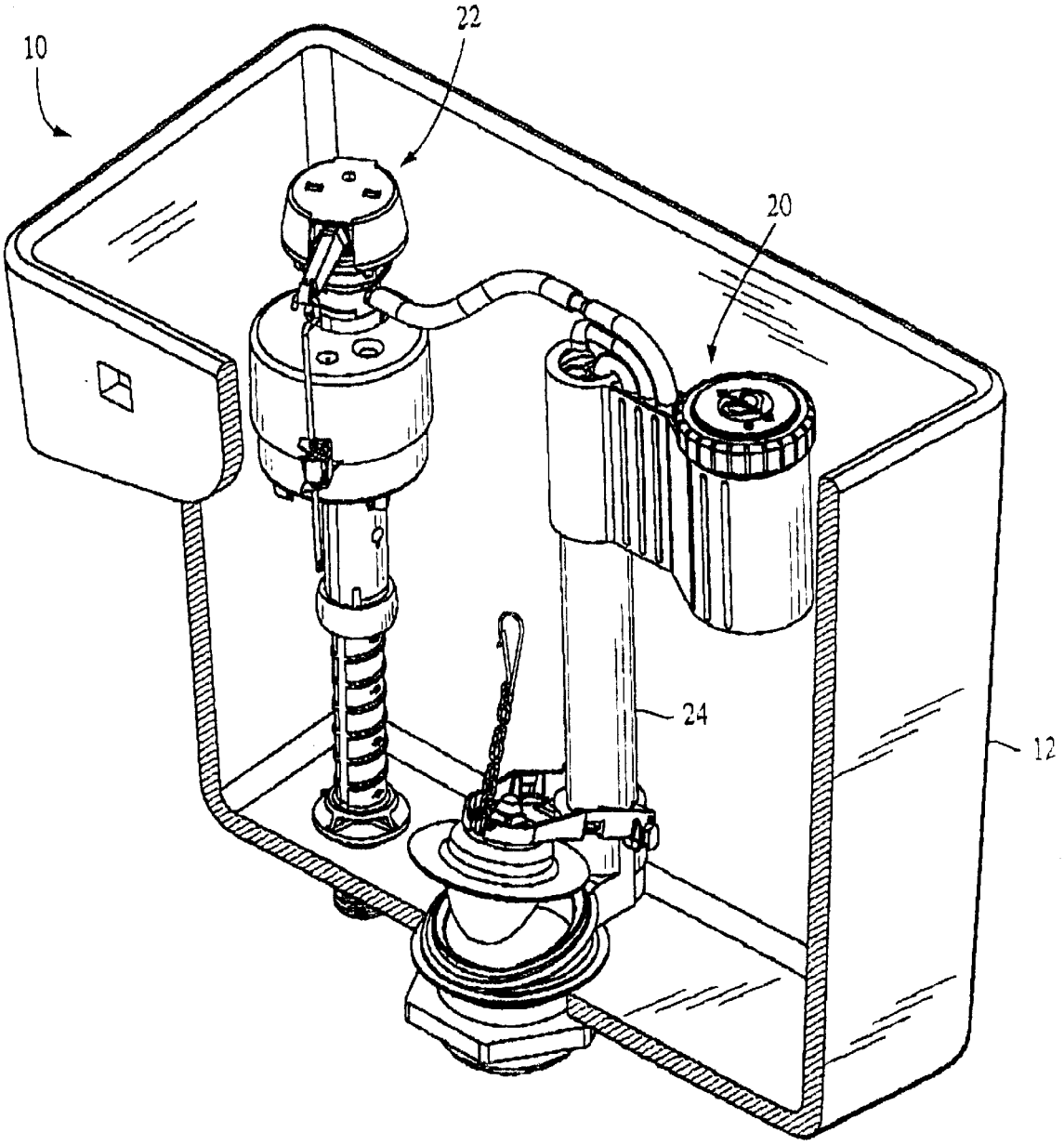
FIG. 1 is a perspective view of a toilet tank employing a preferred dispenser assembly according to the invention

FIG. 1 is a perspective view of a toilet tank assembly 10 employing a preferred dispenser assembly, or dispenser apparatus 20, according to the invention. The tank assembly 10 includes a fill valve 22 and an overflow tube 24. Disposed within a toilet tank 12, the dispenser assembly 20 is coupled to the fill valve 22 and the overflow tube 24. The dispenser assembly 20 is sufficiently compact to fit conveniently within the tank 12 while enabling easy access for maintenance.

Figure 2:
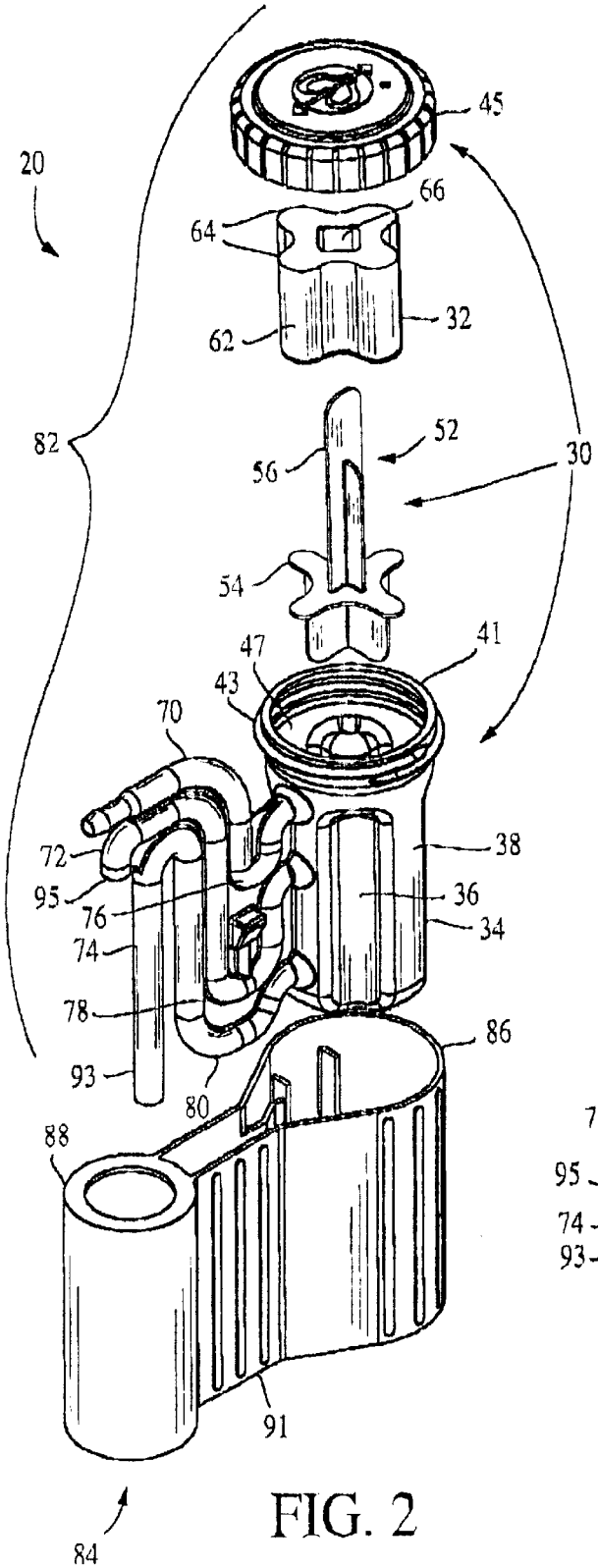
FIG. 2 is an exploded view of the dispenser assembly.
Figure 3:
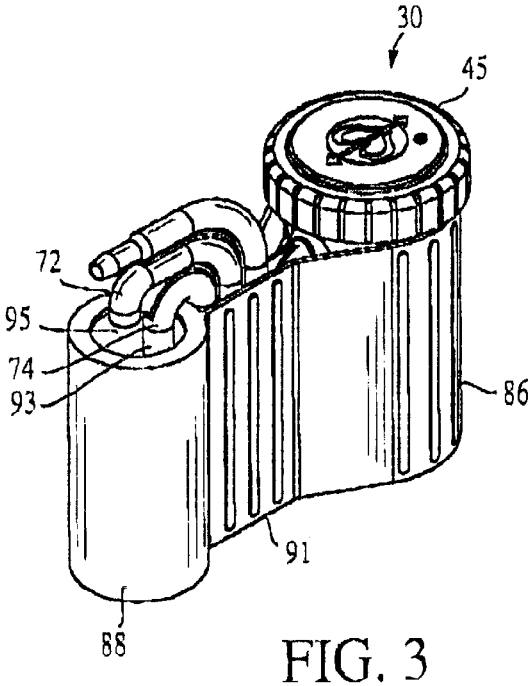
FIG. 3 is a perspective view of the dispenser assembly.
Figure 4:
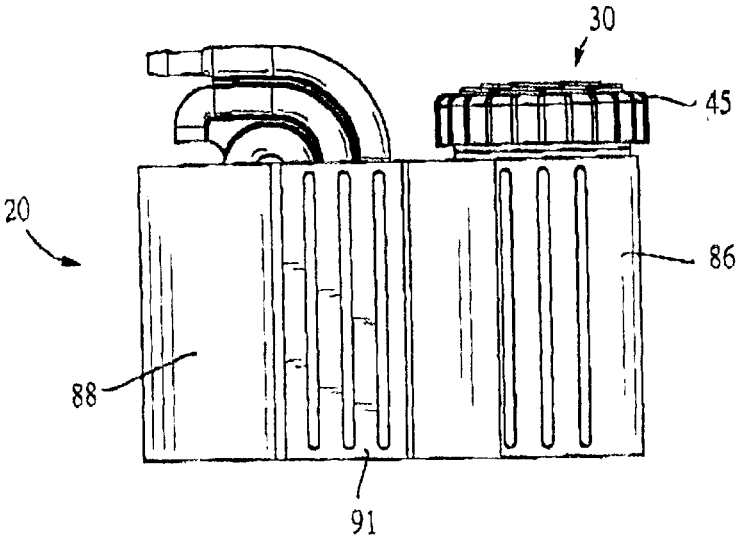
FIG. 4 is a front elevation view of the dispenser assembly.
Figure 5:
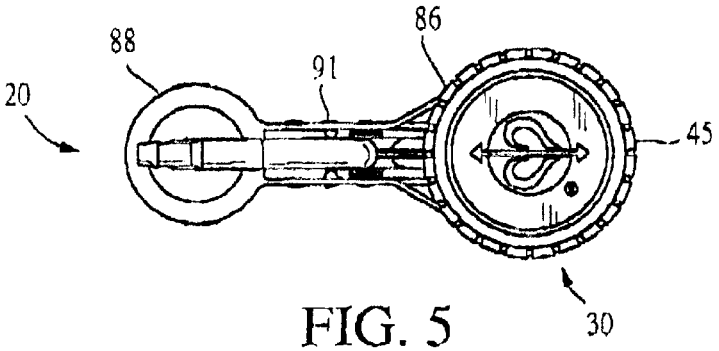
FIG. 5 is a top plan view of the dispenser assembly.
Figure 6:
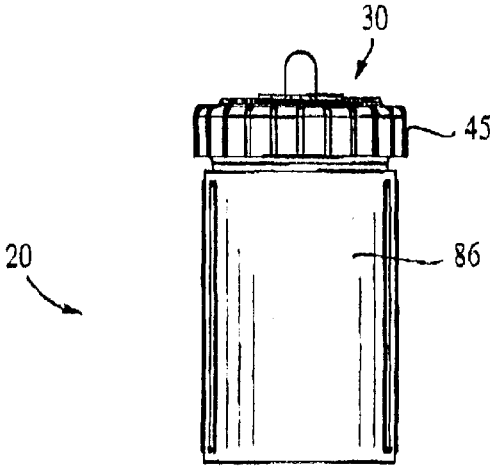
FIG. 6 is a side view the dispenser assembly.

FIG. 2 is an exploded, perspective view of the dispenser assembly 20. The dispenser assembly 20 includes a container 30 for holding a cleaning agent 32. As will be explained below in the operation of the assembly 20, the container 30 also holds water which passes through the assembly 20 and dissolves the agent 32. The container 30 comprises a open top receptacle 34 having a side wall 36 with indentations 38 that extend axially. A top 41 of the receptacle which includes external threads 43 is adapted to mate with internal threads of a removable cap, or lid, 45. The container 30 further comprises a tablet holder 52 disposed within the receptacle 34. The tablet holder 52 includes a base 54 for securely fitting within the receptacle 34 and a bar 56 for retaining the cleaning tablet 32.

The dispenser assembly 20 further includes a uniquely shaped cleaning agent 32 whose outer surface 62 conforms to an inner surface 47 of the receptacle 34. In a preferred embodiment, the cleaning agent 32 comprises multiple lobes 64 that correspond to the lobed shape of the receptacle 34. The agent 32 further comprises a central aperture 66 which receives the bar 56 of the tablet holder 52.

In FIG. 2, multiple tubes are coupled to the container 30. More specifically, a refill tube 70, a tall discharge tube or tall tube 72, and a short discharge tube or short tube 74 are coupled to the receptacle 34. The refill tube 70 is coupled to the fill valve 22. The refill tube 70 includes a U-shaped portion, or U-trap, 76. Each discharge tube or conduit 72, 74 also includes a corresponding U-trap 78, 80, respectively. Since the tubes 70, 72, 74 are disposed outside of the container 30 in the preferred embodiment, the U-traps 76, 78, 80 are thus disposed outside of the container 30.

The tubes 70, 72, 74 and the container 30 form a subassembly 82 that is substantially disposed in a housing 84. The housing 84 includes a first substantially cylindrical portion 86 coupled to a second substantially cylindrical portion 88 by a connector portion 91. In FIGS. 2-6, the first cylindrical portion 86 receives the container 30 while the connector portion 91 receives the U-traps 76, 78, 80 of the tubes 70, 72, 74, respectively. An outlet portion 93 of the short discharge tube 74 is disposed at least in part within the second cylindrical portion 88 while the outlet end 95 of the tall discharge tube 72 is disposed adjacent the second cylindrical portion 88. In FIGS. 36, it will be appreciated that the dispenser assembly 20 comprises a compact structure capable of being conveniently disposed within a toilet tank. Furthermore, the removable lid 45 enables a user to easily access the receptacle for replenishing cleaning agents.

Turning now to FIGS. 7–13, the operation of the dispenser assembly 20 will be described.

Figure 7:
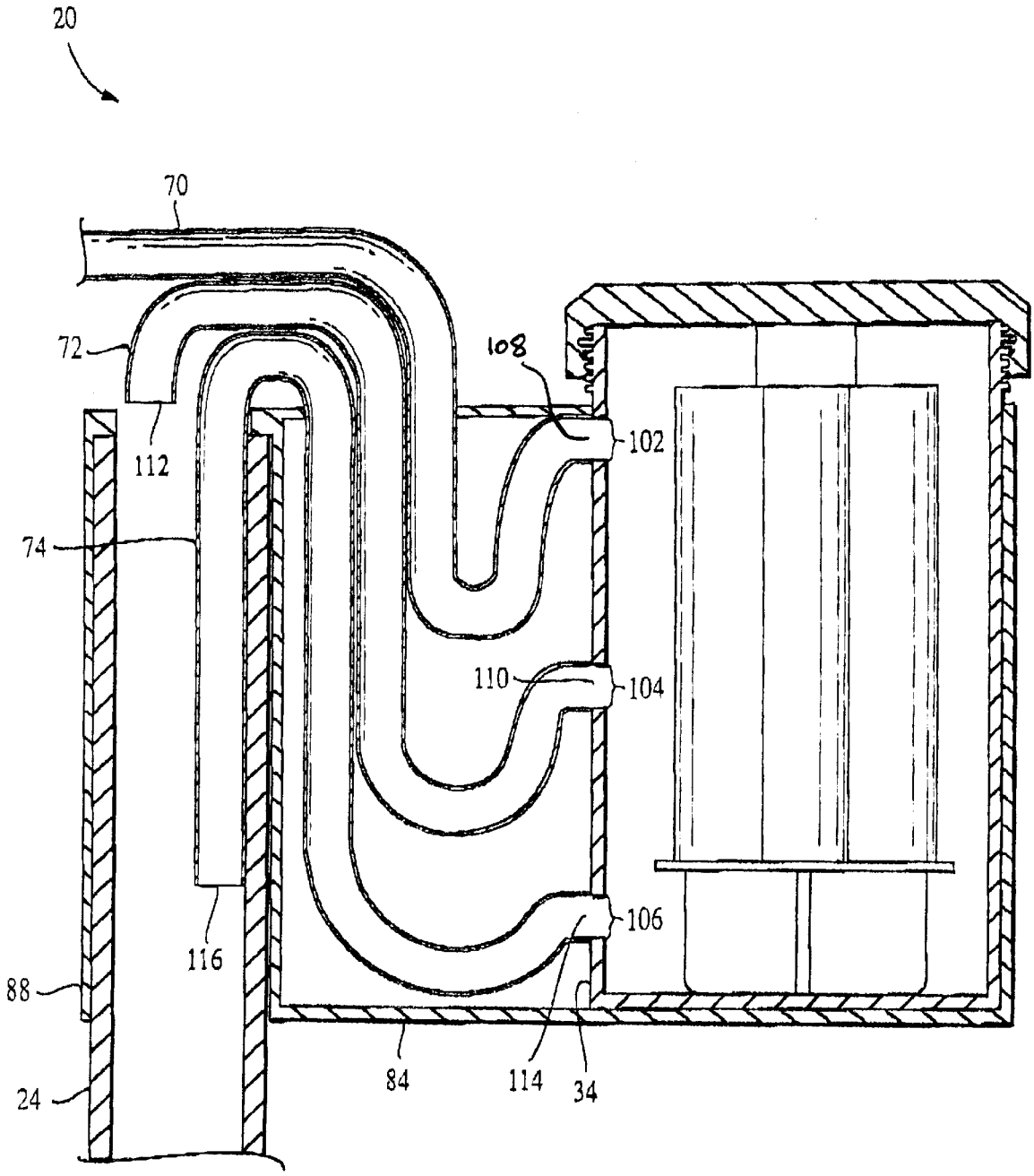
FIG. 7 is a schematic front view of the dispenser assembly prior to operation.

FIG. 7 illustrates a schematic front view of the dispenser assembly 20 upon installation and prior to flushing. The refill tube 70 is coupled to the receptacle 34 at an uppermost position 102 that is higher than an intermediate coupling position 104 of the tall tube 72. The short tube 74 is coupled to the receptacle at a lowermost position 106. The second cylindrical portion 88 of the housing 84 is coupled to the overflow tube 24 by fitting around the tube 24. Being disposed in the second cylindrical portion 88, the tail portion 93 of the short tube 74 is also disposed at least in part within the overflow tube 24. The refill tube 70 includes an exit port 108. The tall tube 72 includes a tall inlet port 110 and a tall outlet port 112 while the short tube 74 includes a short inlet port 114 and a short outlet port 116. The tall inlet port 110 is thus disposed above the short inlet port 114. Though it is not necessary, the tall outlet port 112 is preferably disposed above the short outlet port 116.

Figure 8:
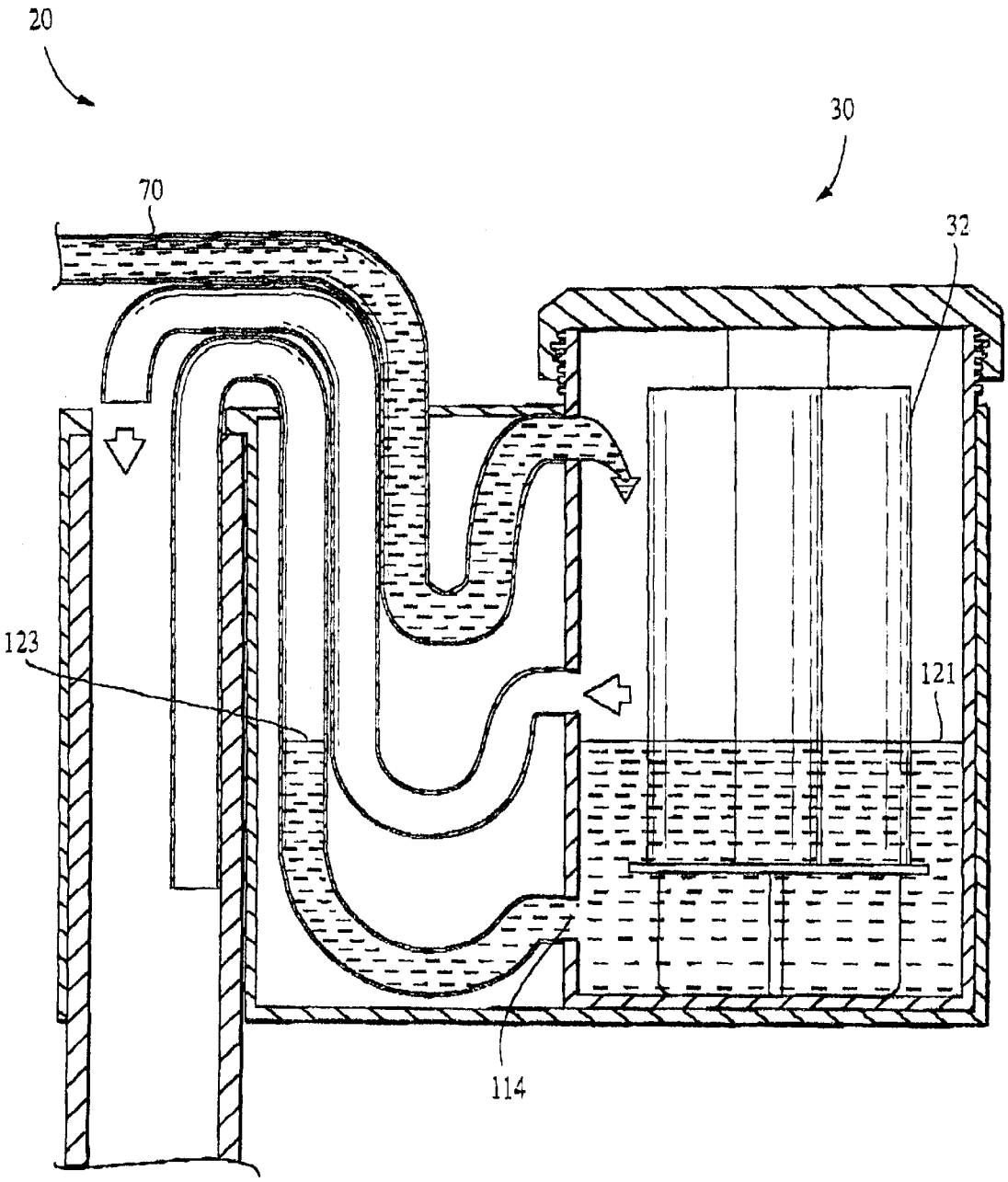
FIG. 8 is a schematic front view of the dispenser assembly in operation as a toilet is initially flushed.
Figure 9:
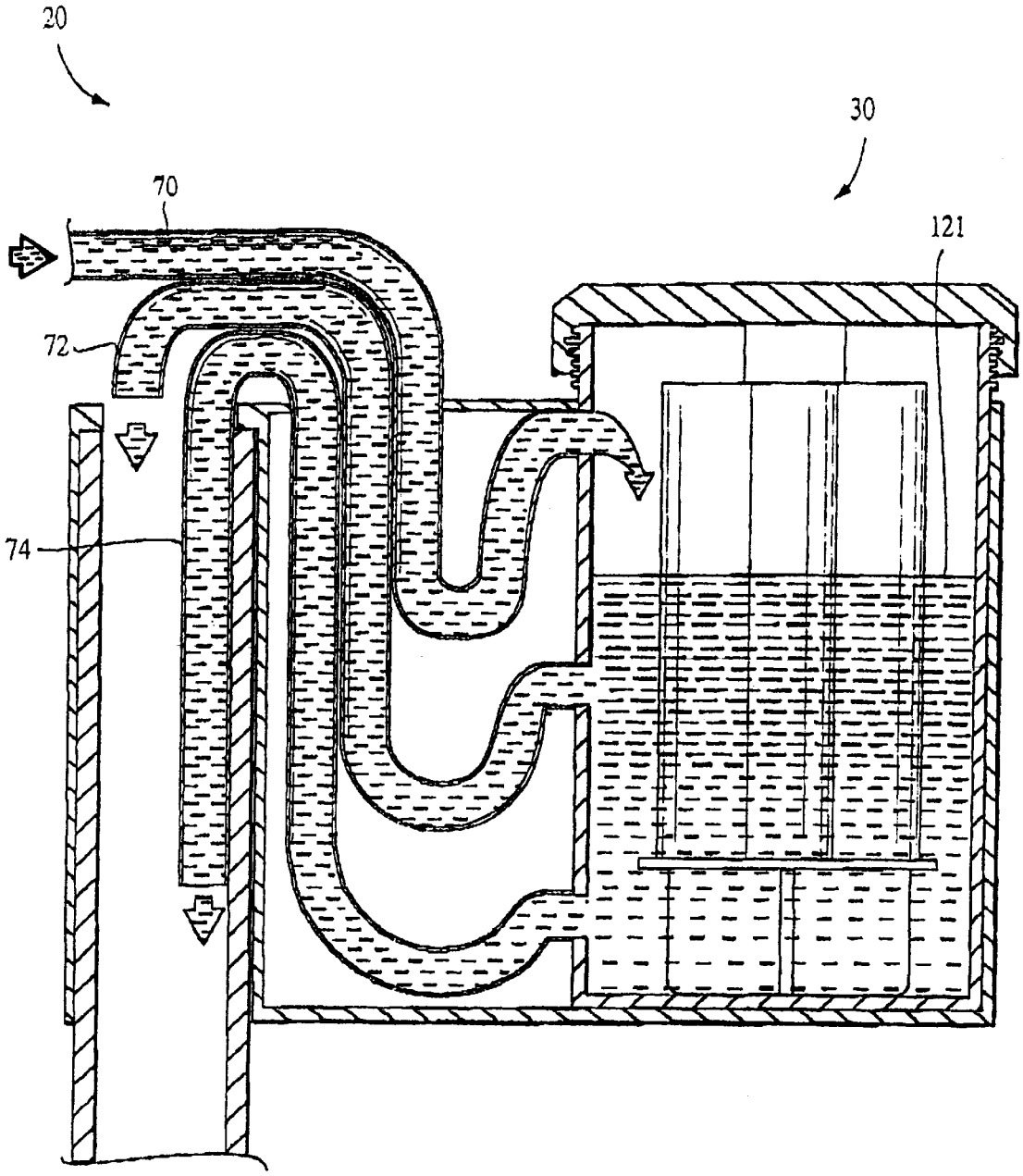
FIG. 9 is a schematic front view of the dispenser assembly in operation as the flushing is almost complete.

When the toilet is flushed, the refill tube 70 directs water from the fill valve to the container 30, as shown in FIG. 8. As the water collected by the container 30 starts to rise to a level 121 above the short inlet port 114, a portion of the water begins to fill the short tube 74, rising to a level 123 substantially equal to the level 121 in the container 30. The water collected by the container 30 absorbs materials from the cleaning agent 32. In FIG. 9, the refill tube 70 continues to direct water from the fill valve into the container 30, thus increasing the level 121 of the water above the tall inlet port 110. The increased pressure within the container 30 causes the water therein to exit through both of the discharge tubes 72, 74. The tubes 72, 74 thus siphon the water out of the container 30.

Figure 10:
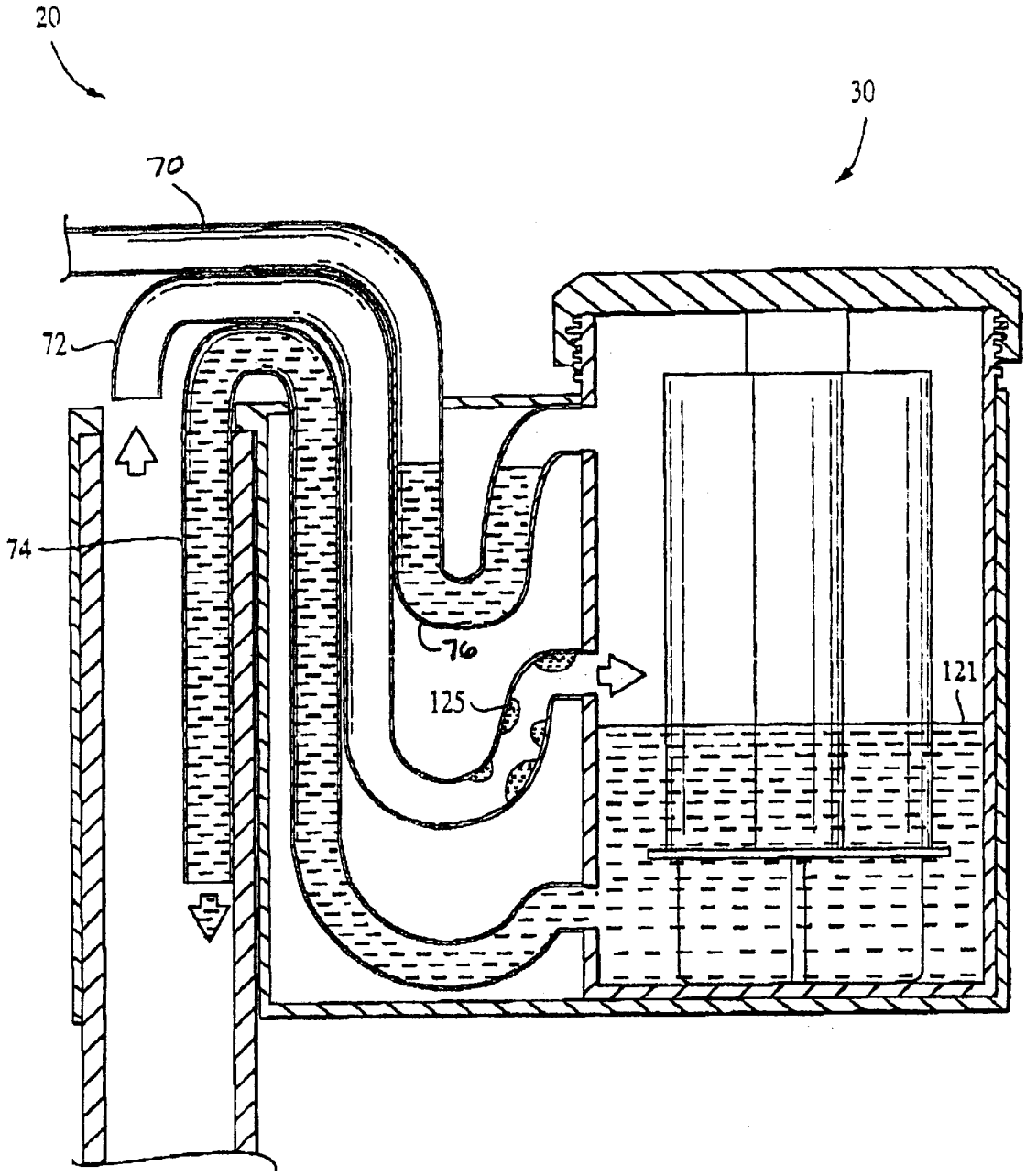
FIG. 10 is a schematic front view of the dispenser assembly in operation after the flush.

As the flush is substantially completed and the fill valve is shut off, as illustrated in FIG. 10, water ceases to flow through the refill tube 70. It is of particular advantage that a portion of the water from the fill valve is retained by the U-trap 76 of the refill tube 70, thereby preventing any fumes from escaping through the tube 70. Though pressure ceases to increase inside the container 30, the siphoning action of the discharge tube 74 will continue to draw water out of the container 30. The tall tube 72 will be substantially emptied of water as air is drawn in to displace the dropping water level 121 in the container 30.

Remnant water droplets 125 cling to the inner surface of the tall tube 72. As the short tube 74 continues to siphon the remaining water in the container 30, the decreasing pressure in the container 30 causes air to flow into the container through the tall tube 72. It will be appreciated that the use of multiple discharge tubes, which in the preferred embodiment comprises a pair, helps prevent a vacuum from developing within the container 30 which would otherwise cause liquid therein from flowing out. Furthermore, the coupling of the discharge tubes 72, 74 to the container 30 at different heights also facilitates the prevention of any vacuum.

Figure 11:
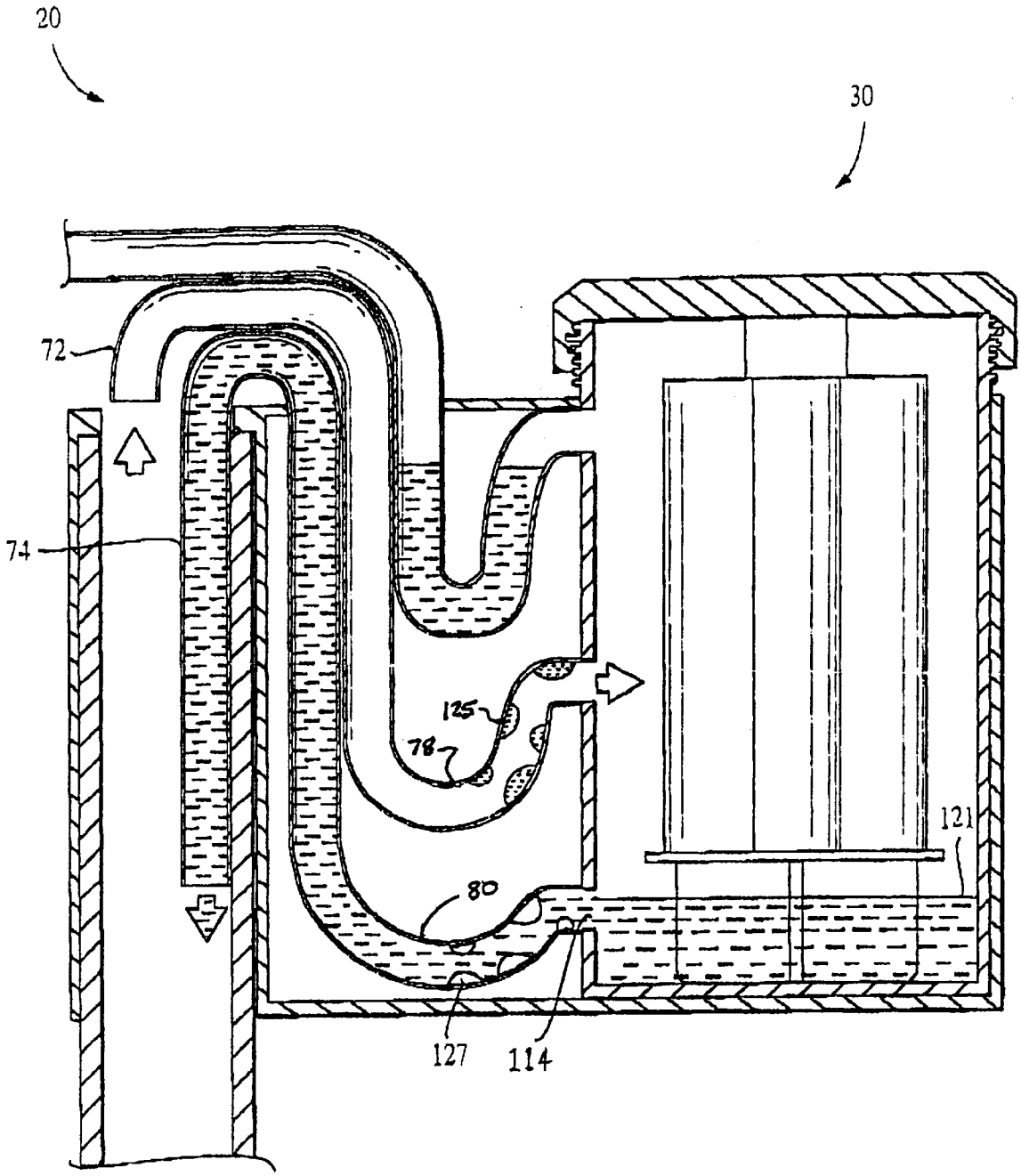
FIG. 11 is a schematic front view of the dispenser assembly in operation as fluid in a container of the assembly is almost drained.

As the water level 121 in the container 30 lowers to the level of the short inlet port 114, the siphon flow through the short tube 74 ceases, and air 127 begins to enter the container 30 through the short tube 74, as shown in FIG. 11. Once the water level 121 in the container 30 drops below the short inlet port 114, the siphoning in the short tube 74 ceases. Liquid is thus trapped in the U-trap 80 of the short tube 74. In the tall tube 72, residual water droplets 125 are disposed on the inner surface thereof by way of surface tension. The inner diameter of the tall tube 72, and more, specifically, the U-trap 78 is configured to be small enough that the droplets 125 will collect to form a seal in the passageway of the tube 72.

Figure 12:
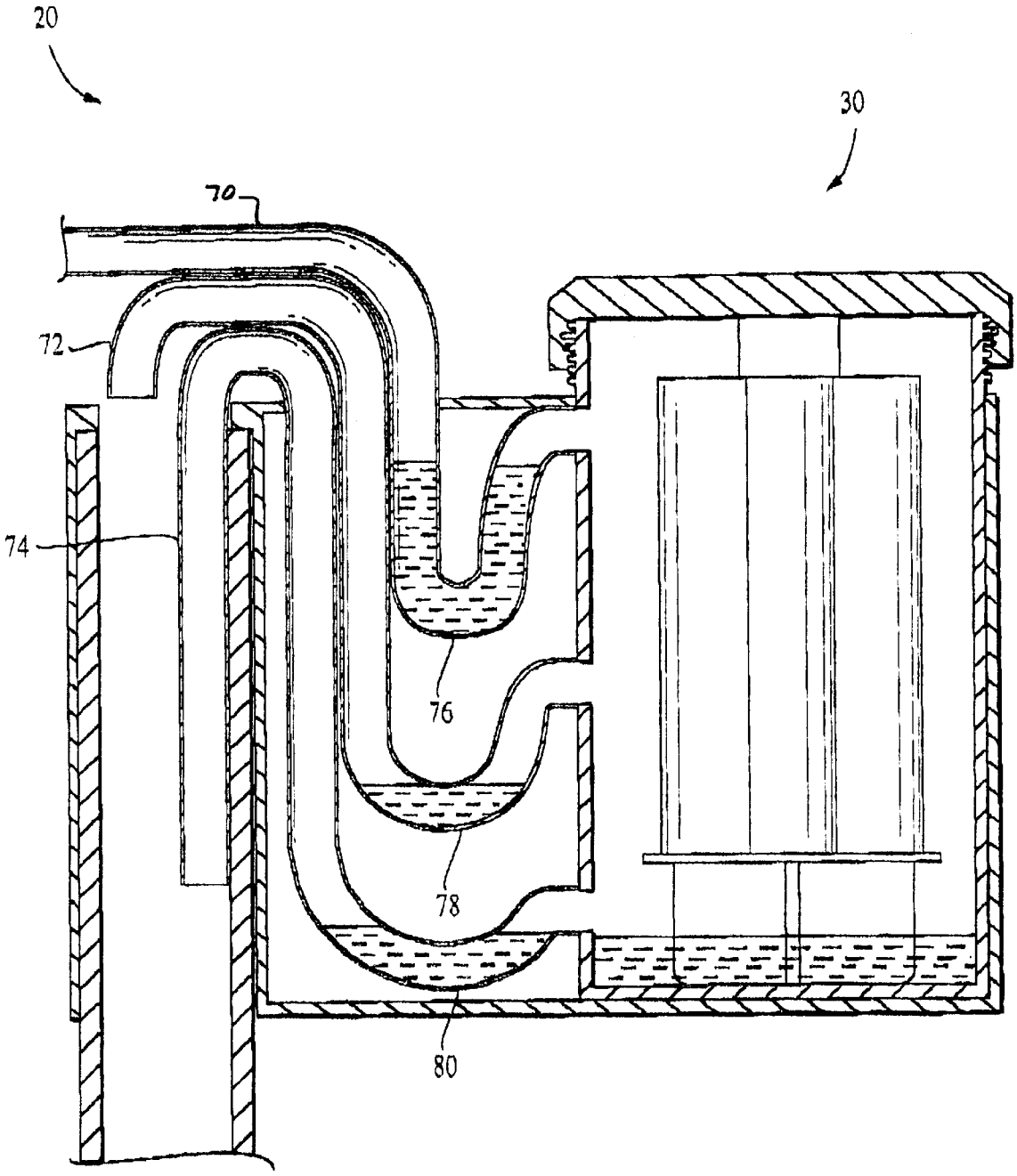
FIG. 12 is a schematic front view of the dispenser assembly in a steady state subsequent to flushing.

FIG. 12 is a schematic view of the dispenser assembly 20 in a steady state subsequent to flushing. As used herein and in the claims, "steady state" refers to a static condition of the dispenser assembly 20 subsequent to flushing when fluid is no longer moving through the dispenser assembly 20. In FIGS. 11 and 12, the water droplets 125 in the tall tube 72 collect in the U-trap 78 so as to seal the tube 72.

It will be appreciated that each of the U-traps 76, 78, 80 retains a sufficient amount of liquid so as to seal the passageways of their respective tubes 70, 72, 74 and thereby to prevent any gas in the container 30, or in the tubes 70, 72, 74, from escaping into the tank. Thus, the combination of the sealed container 30 and sealed tubes 70, 72, 74 forms a sealed environment whereby any fumes generated from the dissolution of the cleaning agent 32 is prevented from escaping into the tank. The dispenser assembly 20 therefore preserves the plumbing within the toilet tank that would otherwise be damaged by a cleaning agent in the tank.

Figure 13:
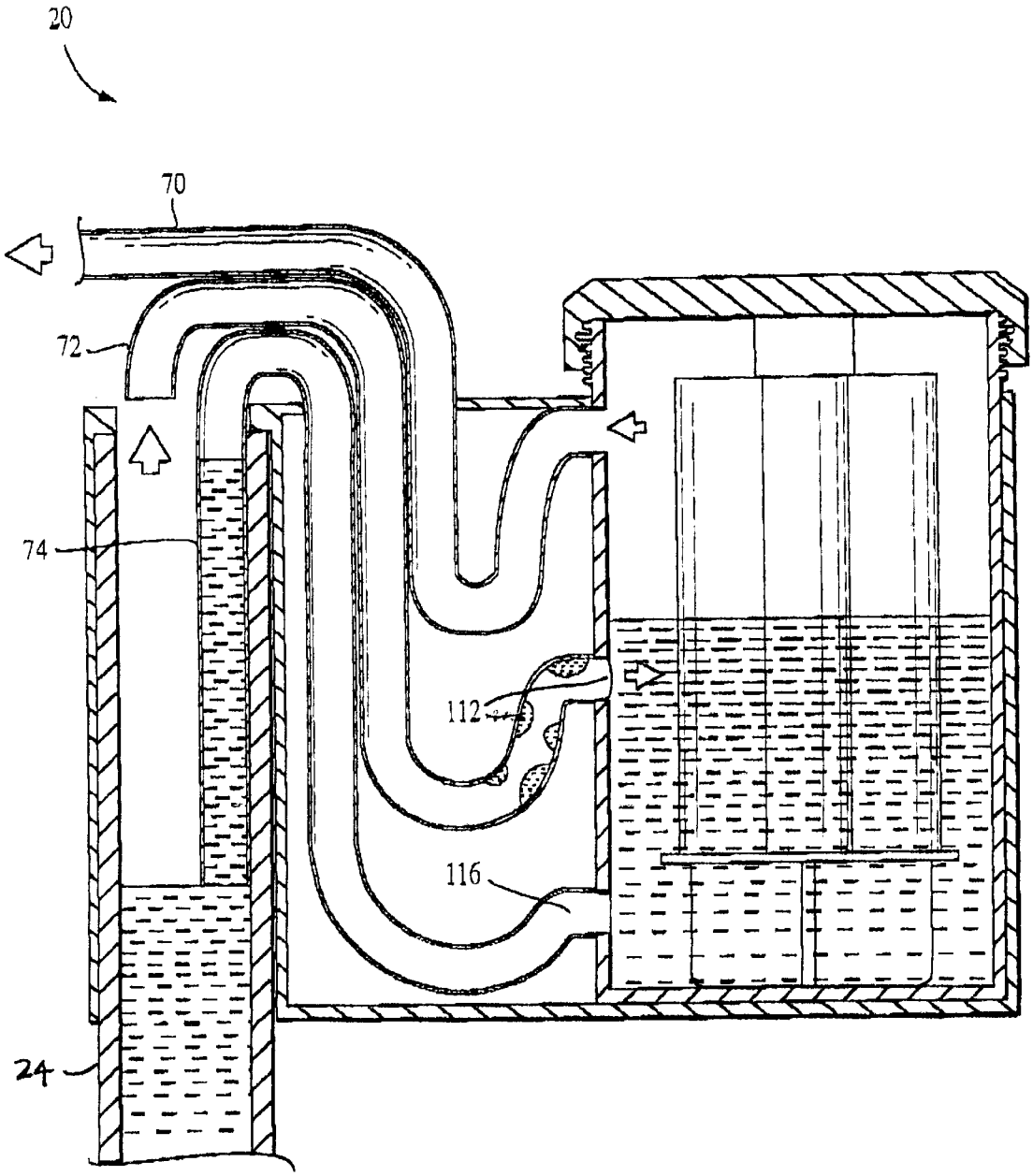
FIG. 13 is a schematic front view of the dispenser assembly illustrating a vacuum breaking feature.

Another unique feature of the dispenser assembly 20 is illustrated in FIG. 13. If the fill valve coupled to the refill tube 70 should draw air out of the container 30 and into the refill tube 70, the employment of multiple discharge tubes helps break a potential vacuum in the container 30. As air is drawn from the container 30 through the refill tube 70, pressure within the container 30 is decreased. However, the tall tube 72 directs air into the container 30, thus breaking any potential vacuum therein. Since the tall outlet port 112 is disposed above the short outlet port 116, the tall tube 72 will not draw in the liquid disposed in the overflow tube 24.

Figure 14:
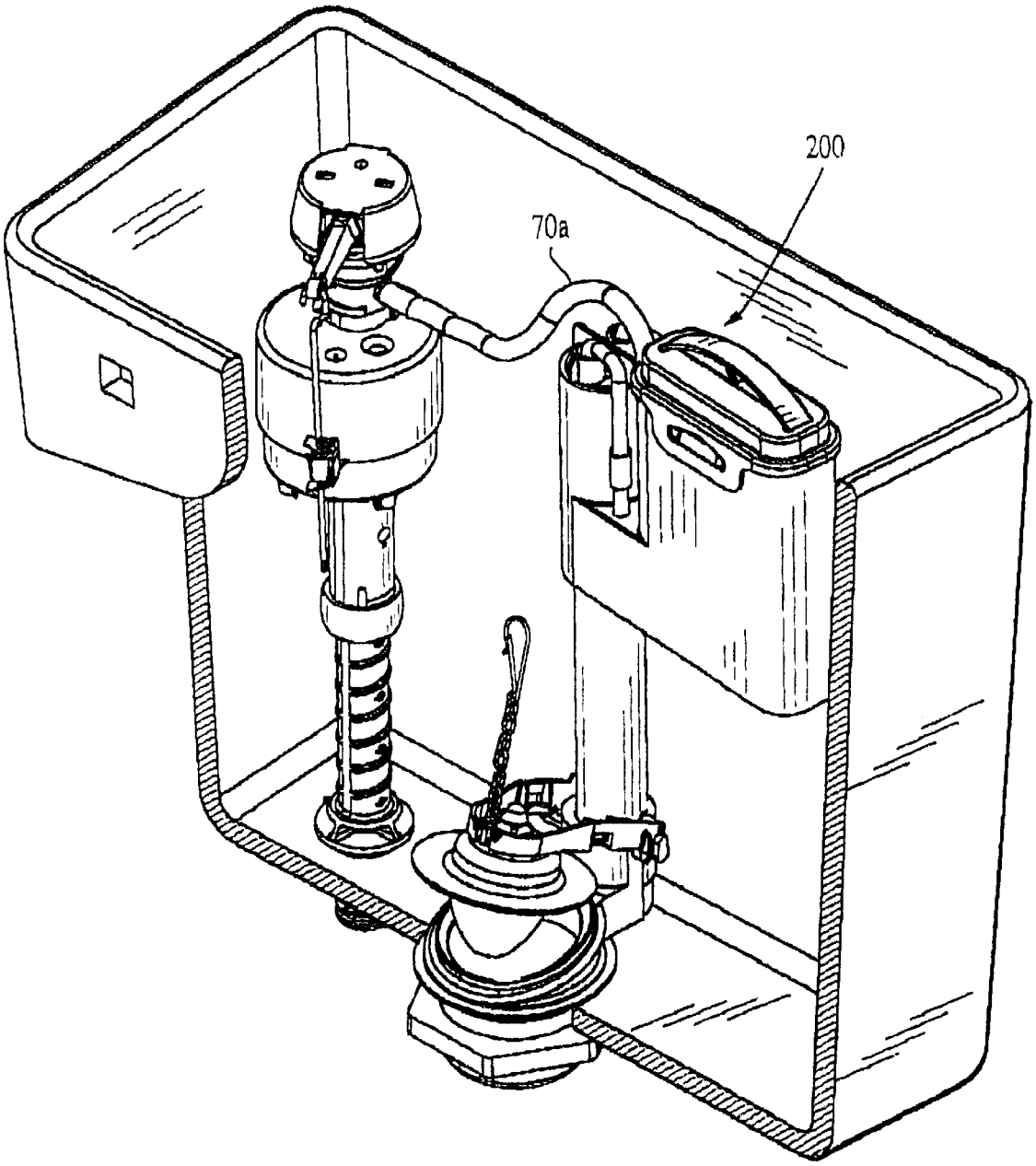
FIG. 14 is a perspective view of a toilet tank employing an alternate embodiment of a dispenser assembly.
Figure 15:
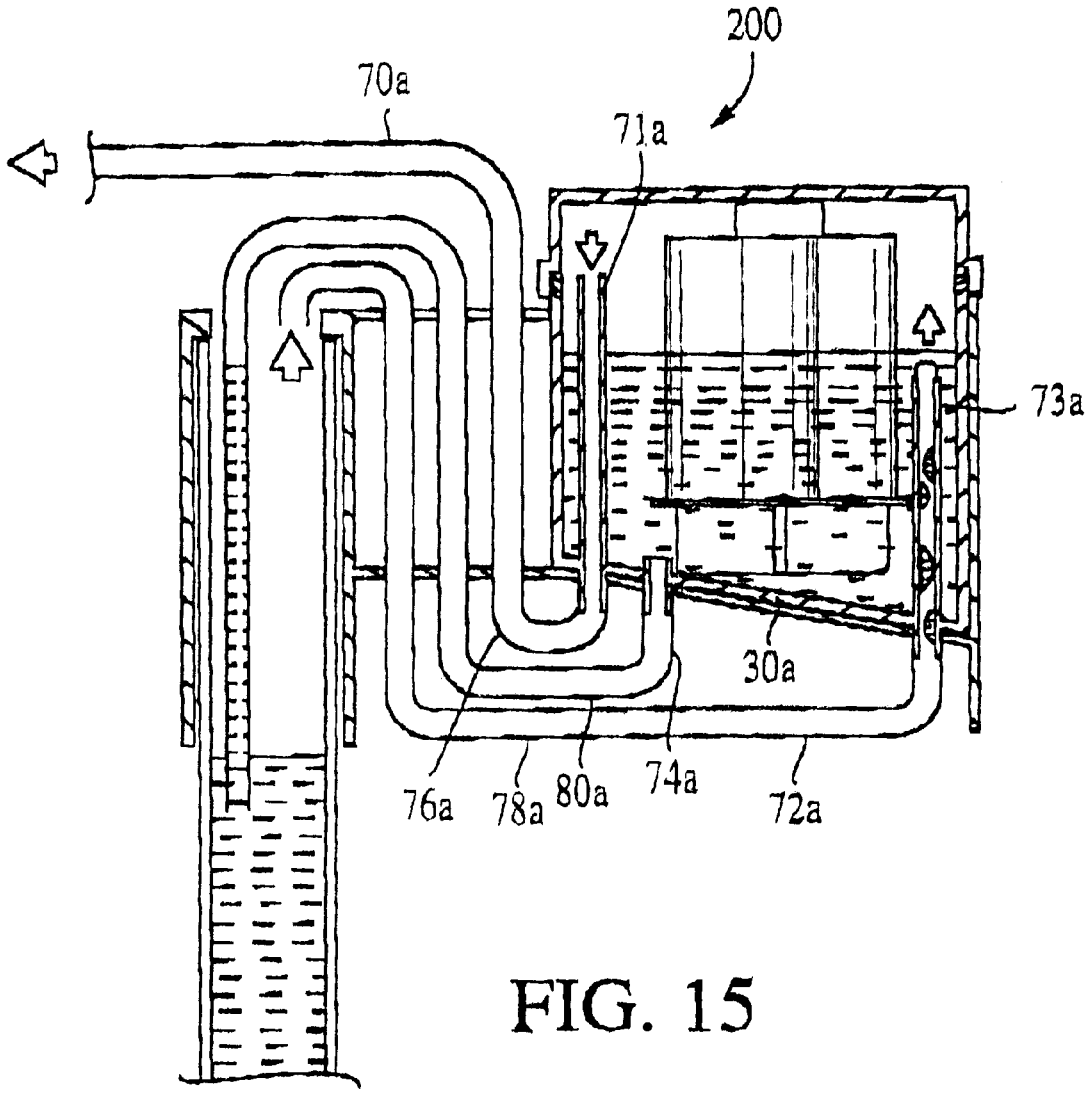
FIG. 15 is a schematic side view of the alternate embodiment of the dispenser assembly in FIG. 14.

FIGS. 14 and 15 illustrate an alternate embodiment 200 wherein the refill tube 70*a* and the discharge tubes 72*a*, 74*a* are inserted through a bottom of the container 30*a*. U-traps 76*a*, 78*a*, 80*a* are formed in the tubes 70*a*, 72*a*, 74 except that portions 71*a* of the 75*a* of the tubes 70*a*, 73*a*, respectively, are disposed within the container 30*a*. The operation of the alternate dispenser assembly 20*a* functions substantially the same as the embodiment shown in FIGS. 1–13.

It will be appreciated that a sealed environment is provided for preventing gases, generated as a result of the water absorbing the cleaning agent 32, from escaping into the tank. It will be further appreciated that the lack of moving parts in the dispenser assembly provides an automatic system of dispensing cleaning agent each time the toilet is flushed. The use of a plurality of discharge tubes prevents a potential vacuum from developing within the container whether liquid is being drained from the container or air is being drawn away from the container by the fill valve.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A cleaner dispenser apparatus adapted for use with a toilet tank having a refill valve and an overflow tube, the apparatus comprising:

a closed container for holding a cleaning agent, the container being adapted for disposition in the toilet tank in fluid communication with the refill valve;

a first conduit coupled to the closed container and adapted to communicate with the overflow tube, the first conduit defining a first passageway in which liquid is disposed when the toilet is in a steady state subsequent to flushing; and a second conduit coupled to the closed container and adapted to communicate with the overflow tube, the second conduit defining a second passageway in which liquid is disposed when the toilet is in a steady state subsequent to flushing.

2. The apparatus of claim 1, wherein the closed container comprises a receptacle and a removable lid.

3. The apparatus of claim 1, wherein:

the closed container has a bottom wall;

the first conduit has a first inlet;

the second conduit has a second inlet; and the first inlet is disposed further from the bottom wall of the closed container than the second inlet.

4. The apparatus of claim 3, wherein:

the first conduit comprises a first outlet;

the second conduit comprises a second outlet; and the first outlet is disposed above the second outlet.

5. The apparatus of claim 3, wherein the first conduit has an inner diameter sufficiently small to cause droplets of liquid disposed on an inner surface of the first conduit by way of surface tension to collect so as to block the first passageway.

6. The apparatus of claim 3, wherein:

the closed container is adapted to hold liquid with a water level;

the first conduit is adapted to direct liquid out of the closed container when the water level is above the first inlet; and the first conduit is adapted to direct air into the closed container when the water level is between the first inlet and the second inlet.

7. The apparatus of claim 1, wherein each of the first passageway and the second passageway is bent back on itself to form a substantially U-shaped configuration.

8. The apparatus of claim 1, further comprising a refill tube in communication with a refill valve and the closed container, the refill tube comprising a U-trap.

9. A toilet, comprising:

a water tank;

a fill valve disposed in the water tank;

a closed container adapted for holding a cleaning agent;

a refill tube coupled to the fill valve and the closed container;

an overflow tube;

a first discharge tube coupled to the closed container and adapted to communicate with the overflow tube, the first discharge tube defining a first passageway; and a second discharge tube coupled to the closed container and adapted to communicate with the overflow tube, the second discharge tube defining a second passageway, wherein the first discharge tube and the second discharge tube are configured to retain sufficient liquid to block the first passageway and the second passageway, respectively, at a steady state subsequent to flushing.

10. The toilet of claim 9, wherein:

the first discharge tube comprises a first inlet;

the second discharge tube comprises a second inlet; and the first inlet is disposed above the second inlet.

11. The toilet of claim 9, wherein:

the first discharge tube comprises a first outlet;

the second discharge tube comprises a second outlet disposed beneath the first outlet.

12. The toilet of claim 9, wherein the first discharge tube and the second discharge tube are U-shaped.

13. A toilet cleaning apparatus for use with a toilet tank having a refill valve and an overflow tube, the apparatus comprising:

means for holding a cleaning agent;

means for directing liquid from the refill valve to the holding means;

means for directing liquid from the holding means to the overflow tube; and means for preventing gas from escaping the holding means into the toilet tank when the toilet tank is in a steady state, wherein the preventing means prevents gas from exiting the means for directing liquid from the holding means to the overflow tube.

14. The apparatus of claim 13, wherein the means for directing liquid from the holding means to the overflow tube further comprises means for simultaneously directing air into the holding means.

15. The apparatus of claim 14, wherein the means for preventing gas from comprises means for trapping liquid.

16. The apparatus of claim 13, wherein the means for directing liquid from the holding means to the overflow tube comprises an outlet portion that is not adapted to form a seal with the overflow tube.

17. A method for automatically cleaning a toilet having a tank, the method comprising:

channeling liquid from a fill valve to a closed container holding a cleaning agent upon flushing;

directing the liquid in the closed container to an overflow tube via first and second discharge lines;

directing air into the closed container via the first discharge line while siphoning fluid out of the closed container via the second discharge line; and preventing gas from escaping the closed container into the tank.

18. The method of claim 17, wherein preventing gas from escaping the closed container into the tank comprises blocking the refill line, the first discharge line, and the second discharge line with the liquid.

19. A cleaner dispenser apparatus adapted for use with a toilet tank having a refill valve and an overflow tube, the apparatus comprising a closed container for holding a cleaning agent and for receiving liquid with a water level;

a refill tube coupled to the closed container at an upper position and adapted to communicate with the refill valve;

a first discharge conduit coupled to the closed container at a lower position and adapted to communicate with the overflow tube; and a second discharge conduit coupled to the closed container at an intermediate position between the upper position and the lower position, wherein the second discharge conduit is adapted to siphon liquid out of the closed container and, alternatively, to direct air into the closed container.

20. The apparatus of claim 19, wherein:

the second discharge tube is adapted to siphon liquid out of the closed container when the water level is above the intermediate position; and the second discharge tube is adapted to direct air into the closed container with the water level is between the intermediate position and the lower position.

21. The apparatus of claim 19, wherein:

the first discharge tube comprises a first water trap;

and the second discharge tube comprises a second water trap.

* * * * *